US009209515B2

(12) United States Patent
Lin et al.

(10) Patent No.: US 9,209,515 B2
(45) Date of Patent: Dec. 8, 2015

(54) THREE-DIMENSIONAL ANTENNA AND A WIRELESS COMMUNICATION APPARATUS PROVIDED WITH THE SAME

(71) Applicant: C/O WISTRON NeWEB CORP, New Taipei (TW)

(72) Inventors: Chia-Hong Lin, New Taipei (TW); Jui-Hsiang Chou, New Taipei (TW); Chang-Hsiu Huang, New Taipei (TW); Shih-Hong Chen, New Taipei (TW); Yi-Cheng Wu, New Taipei (TW)

(73) Assignee: Wistron NeWeb Corporation, New Taipei (TW)

( * ) Notice: Subject to any disclaimer, the term of this patent is extended or adjusted under 35 U.S.C. 154(b) by 446 days.

(21) Appl. No.: 13/677,356

(22) Filed: Nov. 15, 2012

(65) Prior Publication Data

US 2013/0201062 A1 Aug. 8, 2013

(30) Foreign Application Priority Data

Feb. 8, 2012 (TW) ..... 101104059 A

(51) Int. Cl.

| | |
|---|---|
| ***H01Q 1/24*** | (2006.01) |
| ***H01Q 1/36*** | (2006.01) |
| ***H01Q 1/48*** | (2006.01) |
| ***H01Q 1/08*** | (2006.01) |
| ***H01Q 9/26*** | (2006.01) |

(52) U.S. Cl.

CPC ..... *H01Q 1/36* (2013.01); *H01Q 1/084* (2013.01); *H01Q 1/243* (2013.01); *H01Q 1/48* (2013.01); *H01Q 9/26* (2013.01)

(58) Field of Classification Search

CPC ..... H01Q 1/36; H01Q 1/48; H01Q 1/243
USPC ..... 343/702, 848
See application file for complete search history.

(56) References Cited

U.S. PATENT DOCUMENTS

| | | | | |
|---|---|---|---|---|
| 2011/0037672 | A1* | 2/2011 | Tseng et al. | 343/767 |
| 2011/0181480 | A1* | 7/2011 | Hsieh et al. | 343/767 |
| 2011/0234457 | A1* | 9/2011 | Chen | 343/700 MS |
| 2011/0267246 | A1* | 11/2011 | Tseng et al. | 343/750 |
| 2011/0273358 | A1* | 11/2011 | Koyama et al. | 343/876 |

FOREIGN PATENT DOCUMENTS

| | | | |
|---|---|---|---|
| CN | 101378150 | A | 3/2009 |
| CN | 101673871 | A | 3/2010 |
| EP | 1906491 | A1 | 4/2008 |
| WO | 2011073506 | A1 | 6/2011 |

* cited by examiner

*Primary Examiner* — Dameon E Levi
*Assistant Examiner* — Collin Dawkins
(74) *Attorney, Agent, or Firm* — LeClairRyan

(57) ABSTRACT

A three-dimensional antenna includes an L-shaped grounding element and an L-shaped radiating element. The grounding and radiating elements are arranged in a U shape. The grounding element includes a first grounding segment, a second grounding segment extending from the first grounding segment, and a short-circuit point disposed at the second grounding segment. The radiating element includes a first radiating segment opposite to the first grounding segment, a second radiating segment extending from the first radiating segment and adjacent to the second grounding segment, a feeding point disposed at the second radiating segment, and two radiator arms being able to generate respective resonant frequencies.

17 Claims, 6 Drawing Sheets

THREE-DIMENSIONAL ANTENNA AND A WIRELESS COMMUNICATION APPARATUS PROVIDED WITH THE SAME

CROSS-REFERENCE TO RELATED APPLICATION

This application claims priority of Taiwanese Patent Application No. 101104059, filed on Feb. 8, 2012, the disclosure of which is incorporated herein by reference.

BACKGROUND OF THE INVENTION

This invention relates to an antenna and a wireless communication apparatus, more particularly to a low profile three-dimensional antenna and a wireless communication apparatus provided with the same.

FIG. 1 shows a conventional planar monopole antenna 100 of U.S. Pat. No. 7,193,566. The conventional planar monopole antenna 100 includes a substrate (S) having a surface (S1), a ground (G), a radiator (R) and a coaxial cable (W).

The ground (G) is formed on the surface (S1) of the substrate (S) and includes a side (G'), and first and second sleeves (G1, G2) that are parallel to each other and that extend from the side (G') along an axis (Z).

The radiator is longitudinal along the axis (Z), is formed on the surface (S1) of the substrate (S), and is adjacent to the side (G').

The coaxial cable (W) includes a signal wire (W1) electrically coupled to a feed end (RF) of the radiator (R) adjacent to the side G' of the ground G, and a ground wire (W2) electrically coupled to the side (G') of the ground (G) and enclosing the signal wire (W1).

When the conventional planar monopole antenna 100 operates in the range of 400-900 MHz, a length of the radiator (R) is already 14 cm, bringing an overall length (L) of the conventional planar monopole antenna 100 (i.e., the length of the radiator (R) plus a length of the ground (G) greater than 14 cm, that is, greater than ¼ of a wavelength corresponding to a central frequency.

As shown in FIG. 2, although the planar monopole antenna 100 is relatively small in thickness and light in weight, in practice, since the conventional planar monopole antenna 100 has to be erected on a surface (B) of a device for efficient radiation, a profile thereof in a direction along the axis (Z) is relatively high.

SUMMARY OF THE INVENTION

Therefore, the primary object of the present invention is to provide a three-dimensional antenna that can overcome the aforesaid drawback of the prior art.

Accordingly, a three-dimensional antenna of the present invention comprises a grounding element and a radiating element.

The grounding element is a substantially L-shaped grounding conductor and includes a first grounding segment, a second grounding segment, and a short-circuit point. The second grounding segment extends from and is bent with respect to the first grounding segment, and has a grounding end portion. The short-circuit point is disposed at the grounding end portion of the second grounding segment.

The radiating element is a substantially L-shaped radiating conductor, is disposed adjacent to the grounding element, and is arranged with the grounding element in a U shape. The radiating element is formed with a slot and includes a first radiating segment, a second radiating segment, a feeding point, a first radiator arm and a second radiator arm. The first radiating segment is opposite to the first grounding segment. The second radiating segment extends from and is bent with respect to the first radiating segment, and has a radiating end portion adjacent to the grounding end portion of the second grounding segment. The feeding point is disposed at the radiating end portion of the second radiating segment. The first radiator arm has a first resonant frequency for generating a first resonant mode. The second radiator arm is spaced apart from the first radiator arm by the slot, and has a second resonant frequency for generating a second resonant mode.

The three-dimensional antenna further comprises a feeding element including a first feeding portion electrically coupled to the short-circuit point and a second feeding portion electrically coupled to the feeding point.

Another object of the present invention is to provide a wireless communication apparatus.

According to another aspect of the present invention, a wireless communication apparatus comprises an electrical circuit system and a three-dimensional antenna.

The three-dimensional antenna includes a grounding element, a radiating element, and a feeding element.

The grounding element is a substantially L-shaped grounding conductor and includes a first grounding segment, a second grounding segment, and a short-circuit point. The second grounding segment extends from and is bent with respect to the first grounding segment, and has a grounding end portion. The short-circuit point is disposed at the grounding end portion of the second grounding segment.

The radiating element is a substantially L-shaped radiating conductor, is disposed adjacent to the grounding element, and is arranged with the grounding element in a U shape. The radiating element is formed with a slot and includes a first radiating segment, a second radiating segment, a feeding point, a first radiator arm and a second radiator arm. The first radiating segment is opposite to the first grounding segment. The second radiating segment extends from and is bent with respect to the first radiating segment, and has a radiating end portion adjacent to the grounding end portion of the second grounding segment. The feeding point is disposed at the radiating end portion of the second radiating segment. The first radiator arm has a first resonant frequency for generating a first resonant mode. The second radiator arm is spaced apart from the first radiator arm by the slot and has a second resonant frequency for generating a second resonant mode.

The feeding element is electrically coupled to the electrical circuit system for transmitting a radio frequency signal. The feeding element includes a first feeding portion electrically coupled to the short-circuit point, and a second feeding portion electrically coupled to the feeding point.

BRIEF DESCRIPTION OF THE DRAWINGS

Other features and advantages of the present invention will become apparent in the following detailed description of the embodiments of this invention, with reference to the accompanying drawings, in which:

FIG. 6 is a perspective view of a wireless communication apparatus provided with the three-dimensional antenna according to an embodiment of this invention;

DETAILED DESCRIPTION OF THE PREFERRED EMBODIMENT

Figure 1:
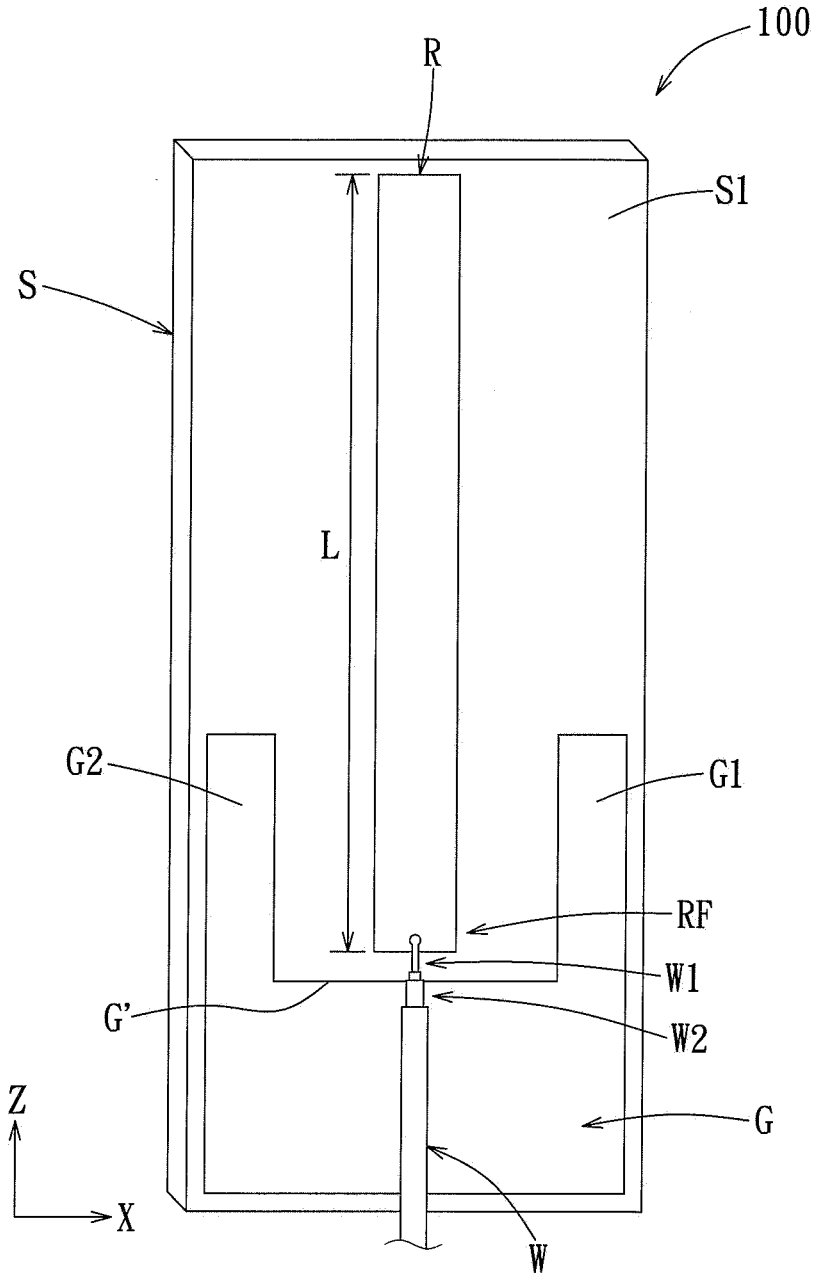
FIG. 1 PRIOR ART
FIG. 1 is a perspective view of a conventional planar monopole antenna.
Figure 2:
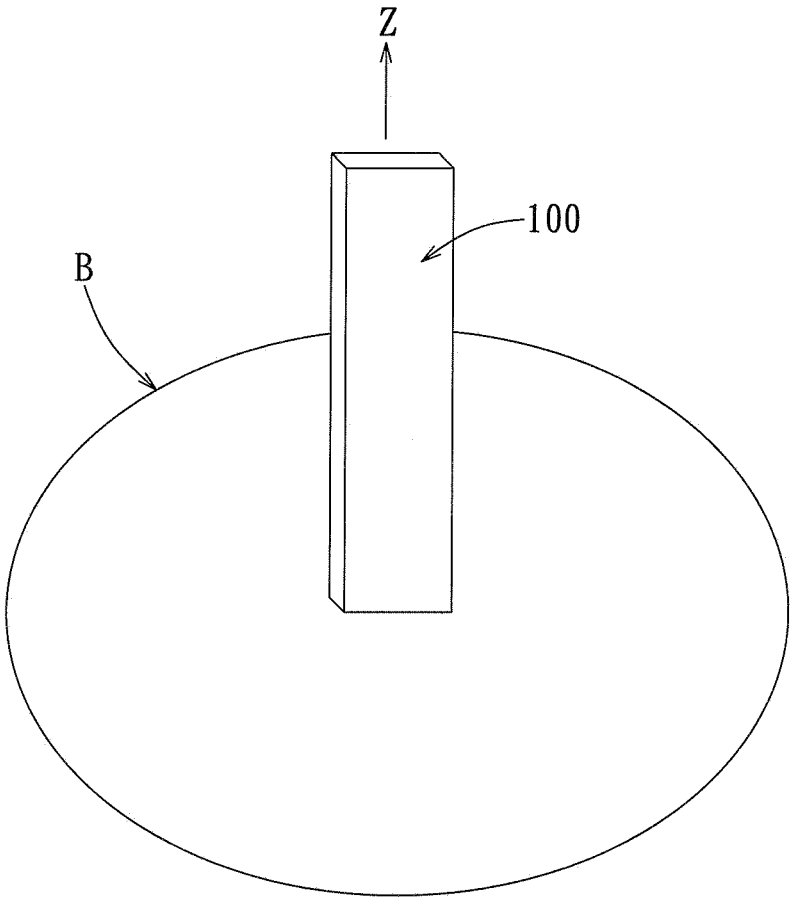
FIG. 2 PRIOR ART
FIG. 2 is a perspective view of a device provided with the conventional planar monopole antenna of FIG. 1.

Before the present invention is described in greater detail with reference to the embodiments, it should be noted that the same reference numerals are used to denote the same elements throughout the following description.

Figure 3:
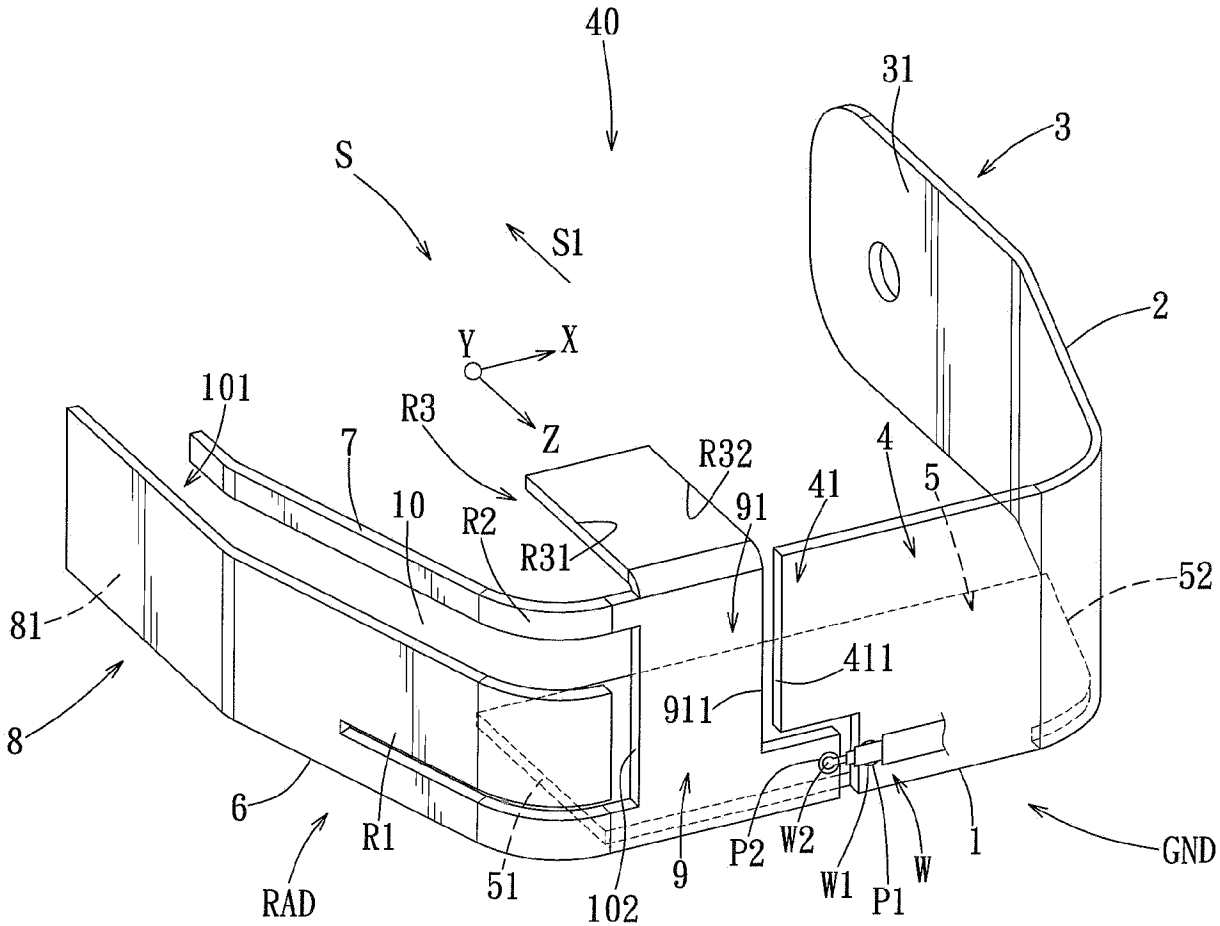
FIG. 3 is a perspective view of a first embodiment of a three-dimensional antenna according to this invention.

As shown in FIG. 3, a first embodiment of a three-dimensional antenna 40 according to this invention includes a grounding element (GND), a radiating element (RAD), and a feeding element (W).

The grounding element (GND) is made by bending a piece of metal, and is a substantially L-shaped grounding conductor.

Similarly, the radiating element (RAD) is made by bending a piece of metal, and is a substantially L-shaped radiating conductor. The grounding element (GND) is arranged with the radiating element (RAD) in a U shape, and cooperate with the radiating element (RAD) to define a space (S) therebetween with an opening (S1).

The grounding element (GND) includes a first grounding edge 1, a second grounding edge 2, a first grounding segment 3 and a second grounding segment 4. Each of the first grounding edge 1 and the second grounding edge 2 is substantially in an L shape, and extends along the first grounding segment 3 and the second grounding segment 4. The first grounding segment 3 has an inner surface 31 between the first and second grounding edges 1, 2. The second grounding segment 4 is bent with respect to and extends from the first grounding segment 3 between the first and second grounding edges 1, 2, and has a grounding end portion 41 having a grounding edge 411. The grounding element (GND) further includes a short-circuit point (P1) disposed at the grounding end portion 41 of the second grounding segment 4.

In this embodiment, the grounding element (GND) further includes a third grounding segment 5 extending from the first grounding edge 1 into the space (S) toward the opening (S1). The third grounding segment 5 has a first lateral edge 51 extending away from the first grounding edge 1 and a second lateral edge 52 spaced apart from and opposite to the first lateral edge 51. In this embodiment, the second lateral edge 52 of the third grounding segment 5 is, but not limited to be, connected to the first grounding segment 3.

The radiating element (RAD) includes a first radiating edge 6, a second radiating edge 7, a first radiating segment 8 and a second radiating segment 9, and is formed with a slot 10. The first and second radiating edges 6, 7 are substantially in an L shape. The first grounding edge 1 and the first radiating edge 6 cooperatively define a U-shaped profile, and the second grounding edge 2 and the second radiating edge 7 cooperatively define a U-shaped profile.

As shown in FIG. 3, the first radiating segment 8 has an inner surface 81 facing the inner surface 31 of the first grounding segment 3 and between the first and second radiating edges 6, 7.

The second radiating segment 9 extends from and is bent with respect to the first radiating segment 8, and has a radiating end portion 91 including a radiating edge 911 that is spaced apart from the grounding edge 411 of the grounding end portion 41 of the second grounding segment 4 and that matches the grounding edge 411 in shape. In this embodiment, a distance between the grounding edge 411 and the radiating edge 911 is 1~2 mm. The radiating element (RAD) further includes a feeding point (P2) disposed at the radiating end portion 91 of the second radiating segment 9.

The slot 10 is a substantially U-shaped slot and has an opening 101 formed at the first radiating segment 8. The radiating element (RAD) further includes a first radiator arm (R1) and a second radiator arm (R2) spaced apart from each other by the slot 10. The first radiator arm (R1) is able to generate a first resonant mode. The second radiator arm (R2) is able to generate a second resonant mode. The slot 10 further has an intermediate segment 102 formed at the second radiating segment 9.

In this embodiment, the radiating element (RAD) further includes a third radiator arm (R3) is able to generate a third resonant mode. The third radiator arm (R3) extends from the second radiating edge 7 of the radiating element (RAD) into the space (S) toward the opening (S1) in a direction along a Z-axis, and is spaced apart from the third grounding segment 5. A projected image of the third radiator arm (R3) overlaps the third grounding segment 5 in a direction along a Y-axis. The third radiator arm (R3) has a first lateral edge (R31) and a second lateral edge (R32). The first lateral edge (R31) extends away from the second radiating edge 7 toward the opening (S1), and corresponds in position to the first lateral edge 51 of the third grounding segment 5 in the direction along the Y-axis. The second lateral edge (R32) of the third radiator arm (R3) extends from the radiating edge 911 toward the opening (S1), and is parallel to and spaced apart from the first lateral edge (R31) of the third radiator arm (R3).

The feeding element (W) includes a first feeding portion (W1) electrically coupled to the short-circuit point (P1), and a second feeding portion (W2) electrically coupled to the feeding point (P2).

For example, the feeding element (W) is, but not limited to, a coaxial cable with a resistance of 50 ohms. The first feeding portion (W1) can be a ground wire (e.g., an outer conductor of the coaxial cable), and the second portion (W2) can be a signal wire (e.g., an inner conductor of the coaxial cable). Alternatively, the feeding element (W) may be a micro-strip line, the first feeding portion (W1) may be a ground conductor, and the second feeding portion (W2) may be a strip conductor spaced apart from the ground conductor.

The feeding element (W) is used for transmitting, but not for radiating, energy of a radio frequency in an ideal state. In practice, the feeding element (W) still radiates a part of the energy of the radio frequency, so that a summation of electrical lengths of the feeding element (W) and the first radiator arm (R1) is inversely proportional to the first resonant frequency associated with the first resonant mode. Similarly, a summation of electrical lengths of the feeding element (W) and the second radiator arm (R2) is inversely proportional to the second resonant frequency associated with the second resonant mode, and a summation of electrical lengths of the feeding element (W) and the third radiator arm (R3) is inversely proportional to the third resonant frequency associated with the third resonant mode.

Figure 4:
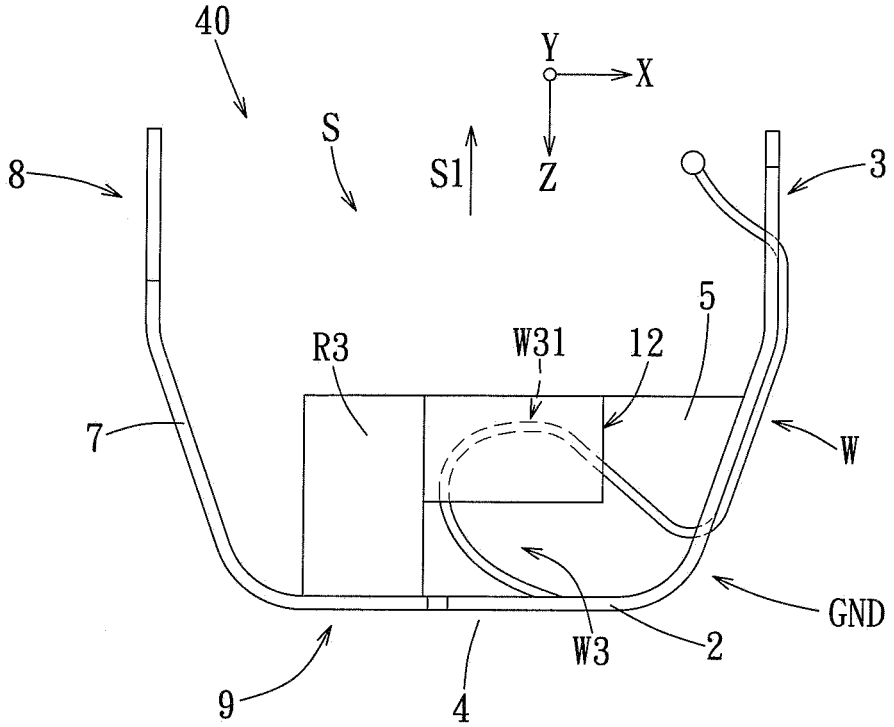
FIG. 4 is a top view of a second embodiment of a three-dimensional antenna according to this invention.
Figure 5:
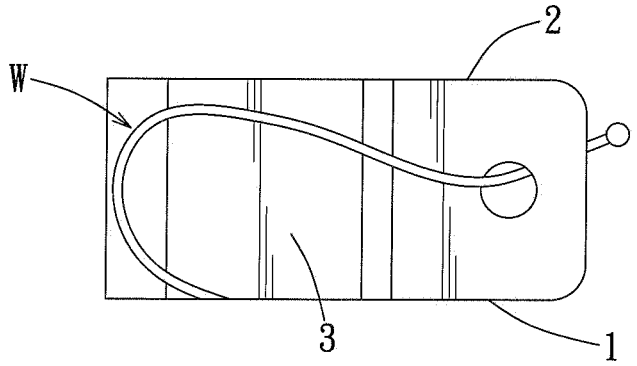
FIG. 5 is a side view of the second embodiment.

FIG. 4 and FIG. 5 show a second embodiment of a three-dimensional antenna 40 similar to the first embodiment. In the second embodiment, the three-dimensional antenna 40 further includes a conducting adhesive tape 12 electrically coupled to the grounding element (GND) for making the feeding element (W) adhere to the third grounding segment 5 of the grounding element (GND). Moreover, the conducting adhesive tape 12 is insulated from the first feeding portion (W1) (shown in FIG. 3) of the feeding element (W) by an insulator, which can be a plastic insulating layer, such as an outer insulating layer coated on the outer conductor of the coaxial cable. The conducting adhesive tape 12 is capable of varying energy distribution of the feeding element (W) so as to adjust impedance matching of the three-dimensional antenna 40 for alleviating the energy radiated from the feeding element (W).

Moreover, the feeding element (W) further includes a feeding line (W3) that is wound for adjusting the impedance matching. The feeding line (W3) has a segment (W31) sandwiched between the conducting adhesive tape 12 and the third grounding segment 5 of the grounding element (GND).

Figure 6:
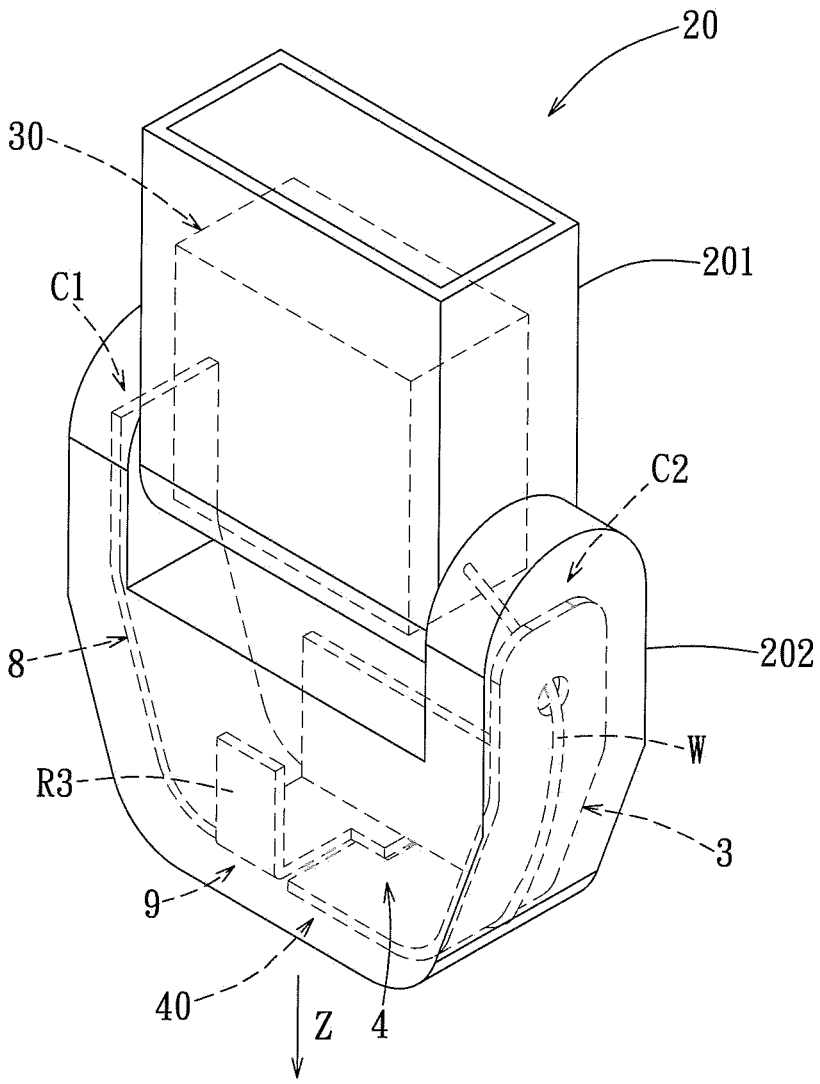
FIG. 6 is another perspective view of the fastening member.
Figure 7:
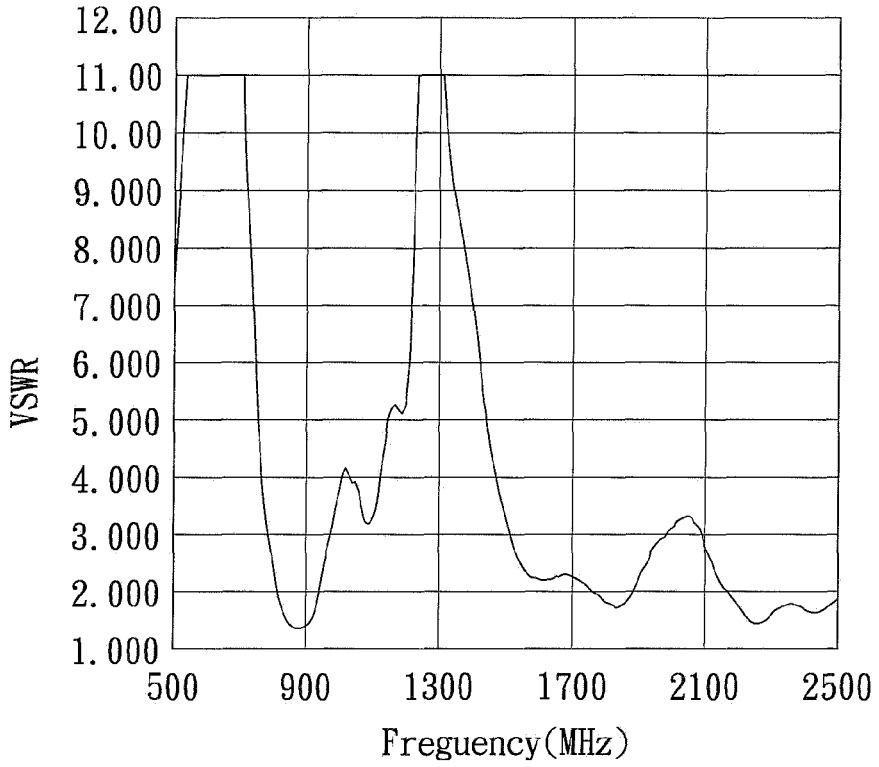
FIG. 7 is a plot illustrating voltage standing wave ratio of the embodiment of the wireless communication apparatus.

FIG. 6 shows an embodiment of a wireless communication apparatus that includes a casing unit 20, an electrical circuit system 30, and the three-dimensional antenna 40 of the first embodiment The casing unit 20 includes a first casing 201 and a second casing 202. The second casing 202 is pivotally connected to the first casing 201, and is pivotable with respect to the first casing 201.

The electrical circuit system 30 is disposed in the first casing 201. The three-dimensional antenna 40 is disposed in the second casing 202.

The feeding element (W) of the three-dimensional antenna 40 passes through the first and second casings 201, 202, and is electrically coupled to the electrical circuit system 30, the short-circuit point (P1) and the feeding point (P2) (referring to FIG. 3) for transmitting energy of a radio frequency signal.

It should be noted that the three-dimensional antenna 40 may be made of a piece of metal or a flexible electric conducting board before being placed in the casing unit 20. Alternatively, the three-dimensional antenna 40 may be integrated with the second casing 202 at a surface of the second casing 202. Namely, the three-dimensional antenna 40 is not limited to a piece of metal, an electric conducting board, a film or being integrated with the casing unit 20, and may be manufactured in different manners depending on requirements of different products, as long as it has a substantially same structure and is capable of electric conduction.

Referring to FIG. 3 to FIG. 7, when the three-dimensional antenna 40 of the first and second embodiments resonates, the first radiator arm (R1) generates the first resonant mode with a first bandwidth (e.g., 824~896 MHz, CDMA BC0-CELL), the second radiator arm (R2) generates the second resonant mode with a second bandwidth (e.g., 1575.42±1.024 MHz, GPS), and the third radiator arm (R3) generates the third resonant mode with a third bandwidth (e.g., 1850~1990 MHz, CDMA BC1-PCS).

Since voltage standing wave ratios (VSWRs) within the first, second and third bandwidths are lower than 3, the three-dimensional antenna 40 of the described embodiments alleviates impedance unmatching problem attributed to interference among radiated energies under a three-dimensional structure.

Figure 8:
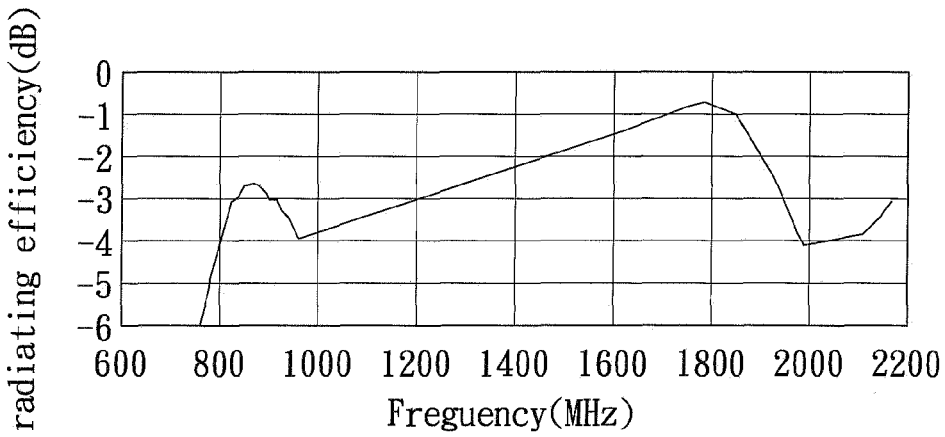
FIG. 8 is a plot illustrating radiating efficiency of the embodiment of the wireless communication device.

Referring to FIG. 8, the first, second and third bandwidths not only have relatively great impedance matching where the voltage standing wave ratio is lower than 3, but also have relatively great radiating efficiency of higher than −4 dB.

To sum up, the grounding element (GND) and the radiating element (RAD) are respectively in an L shape, and are arranged with each other in a U shape, so that a profile of the three-dimensional antenna 40 in the direction along the Z-axis is relatively lower. Further, since the third radiator arm (R3) and the third grounding segment 5 are bent toward the space (S), the profile of the three-dimensional antenna 40 in the direction along the Z-axis will not be increased.

While the present invention has been described in connection with what are considered the most practical embodiments, it is understood that this invention is not limited to the disclosed embodiments but is intended to cover various arrangements included within the spirit and scope of the broadest interpretation and equivalent arrangements.

What is claimed is:

1. A three-dimensional antenna comprising:

a grounding element that is a substantially L-shaped grounding conductor and that includes;

a first grounding segment;

a second grounding segment extending from and being bent with respect to said first grounding segment and having a grounding end portion; and a short-circuit point disposed at said grounding end portion of said second grounding segment, and a radiating element that is a substantially L-shaped radiating conductor, that is disposed adjacent to said grounding element, that is arranged with said grounding element in a U shape, that is formed with a slot, and that includes a first radiating segment opposite to said first grounding segment, a second radiating segment extending from and being bent with respect to said first radiating segment and having a radiating end portion adjacent to said grounding end portion of said second grounding segment, a feeding point disposed at said radiating end portion of said second radiating segment, a first radiator arm being able to generate a first resonant mode, and a second radiator arm that is spaced apart from said first radiator arm and that is able to generate a second resonant mode;

wherein said grounding element further includes a first grounding edge and a second grounding edge, each of which is substantially in an L shape and extends along said first and second grounding segments, and said radiating element further includes a first radiating edge and a second radiating edge, each of which is substantially in an L shape and extends along said first and second radiating segments, said first and second grounding edges being arranged with said first and second radiating edges in U-shaped profiles, respectively; and wherein said grounding element and said radiating element cooperatively define a space therebetween, and said grounding element further includes a third grounding segment extending from said first grounding edge into said space.

2. The three-dimensional antenna as claimed in claim 1, wherein said radiating element further includes a third radiator arm extending from said second radiating edge into said space between said grounding element and said radiating element and spaced apart from said third grounding segment, a projected image of said third radiator arm overlapping said third grounding segment.

3. The three-dimensional antenna as claimed in claim 2, wherein said third radiator arm has a lateral edge extending away from said second radiating edge, and said third grounding segment has a lateral edge extending away from said first grounding edge and corresponding in position to said lateral edge of said third radiator arm.

4. The three-dimensional antenna as claimed in claim 1, wherein said slot has an opening formed at said first radiating segment.

5. The three-dimensional antenna as claimed in claim 1, wherein said slot is a substantially U-shaped slot.

6. The three-dimensional antenna as claimed in claim 5, wherein said substantially U-shaped slot has an opening formed at said first radiating segment, and an intermediate segment formed at said second radiating segment.

7. The three-dimensional antenna as claimed in claim 1, wherein said radiating end portion of said second radiating segment includes a radiating edge, and said grounding end portion of said second grounding segment includes a grounding edge that is spaced apart from said radiating edge and that matches said radiating edge in shape and that is adjacent to said radiating edge.

8. The three-dimensional antenna as claimed in claim 1, further comprising a feeding element that includes a first feeding portion electrically coupled to said short-circuit point and a second feeding portion electrically coupled to said feeding point.

9. A wireless communication apparatus, comprising:

an electrical circuit system; and a three-dimensional antenna including a grounding element that is a substantially L-shaped grounding conductor and that includes a first grounding segment, a second grounding segment extending from and being bent with respect to said first grounding segment and having a grounding end portion, and a short-circuit point disposed at said grounding end portion of said second grounding segment, and a radiating element that is a substantially L-shaped radiating conductor, that is disposed adjacent to said grounding element, that is arranged with said grounding element in a U-shape, that is formed with a slot, and that includes a first radiating segment opposite to said first grounding segment, a second radiating segment extending from and being bent with respect to said first radiating segment and having a radiating end portion adjacent to said grounding end portion of said second grounding segment, a feeding point disposed at said radiating end portion of said second radiating segment, a first radiator arm being able to generate a first resonant mode, and a second radiator arm that is spaced apart from said first radiator arm and that is able to generate a second resonant mode, and a feeding element electrically coupled to said electrical circuit system for transmitting a radio frequency signal, and including a first feeding portion electrically coupled to said short-circuit point and a second feeding portion electrically coupled to said feeding point;

wherein said grounding element further includes a first grounding edge and a second grounding edge, each of which is substantially in an L shape and extends along said first and second grounding segments, and said radiating element further includes a first radiating edge and a second radiating edge, each of which is substantially in an L shape and extends along said first and second radiating segments, said first and second grounding edges being arranged with said first and second radiating edges in U-shaped profiles, respectively; and wherein said grounding element and said radiating element cooperatively define a space therebetween, and said grounding element further includes a third grounding segment extending from said first grounding edge into said space.

10. The wireless communication apparatus as claimed in claim 9, wherein said radiating element of said three-dimensional antenna further includes a third radiator arm extending from said second radiating edge into said space between said grounding element and said radiating element and spaced apart from said third grounding segment, a projected image of said third radiator arm overlapping said third grounding segment.

11. The wireless communication apparatus as claimed in 10, wherein said third radiator arm has a lateral edge extending away from said second radiating edge, and said third grounding segment has a lateral edge extending away from said first grounding edge and corresponding in position to said lateral edge of said third radiator arm.

12. The wireless communication apparatus as claimed in claim 9, wherein said slot has an opening formed at said first radiating segment.

13. The wireless communication apparatus as claimed in claim 9, wherein said slot of said three-dimensional antenna is a substantially U-shaped slot.

14. The wireless communication apparatus as claimed in claim 13, wherein said substantially U-shaped slot has an opening formed at said first radiating segment, and an intermediate segment formed at said second radiating segment.

15. The wireless communication apparatus as claimed in claim 9, wherein said radiating end portion of said second radiating segment includes a radiating edge, and said grounding end portion of said second grounding segment includes a grounding edge that is spaced apart from said radiating edge and that matches said radiating edge in shape and that is adjacent to said radiating edge.

16. The wireless communication apparatus as claimed in claim 15, wherein a summation of electrical lengths of said feeding element and said first radiator arm is inversely proportional to the first resonant frequency associated with the first resonant mode.

17. A wireless communication apparatus as claimed in claim 9 further comprising a casing unit that includes a first casing and a second casing pivotally connected to said first casing, wherein said electrical circuit system is disposed in said first casing and said three-dimensional antenna is disposed in said second casing.

* * * * *